US009662593B2

(12) United States Patent
Eisenberg

(10) Patent No.: US 9,662,593 B2
(45) Date of Patent: May 30, 2017

(54) MECHANICAL CONNECTION UNIT

(71) Applicant: Jacob Eisenberg, Suffern, NY (US)

(72) Inventor: Jacob Eisenberg, Suffern, NY (US)

( * ) Notice: Subject to any disclaimer, the term of this patent is extended or adjusted under 35 U.S.C. 154(b) by 0 days.

(21) Appl. No.: 15/136,122

(22) Filed: Apr. 22, 2016

(65) Prior Publication Data

US 2016/0310863 A1 Oct. 27, 2016

Related U.S. Application Data

(60) Provisional application No. 62/178,875, filed on Apr. 22, 2015.

(51) Int. Cl.
*A63H 33/00* (2006.01)
*A63H 33/06* (2006.01)

(52) U.S. Cl.
CPC ..... *A63H 33/06* (2013.01)

(58) Field of Classification Search
CPC ..... A63H 33/04; A63H 33/06; A63H 33/084
USPC ..... 446/124, 125, 127
See application file for complete search history.

(56) References Cited

U.S. PATENT DOCUMENTS 1,621,178 A * 3/1927 Strub ..... A63H 33/04 446/85
2,216,915 A * 10/1940 Johnson ..... A63F 9/12 273/157 R
4,121,831 A * 10/1978 Greene ..... A63F 9/12 273/160
4,133,538 A * 1/1979 Ambrose ..... A63F 3/00 273/157 R
4,197,669 A * 4/1980 Hynes ..... A63H 33/084 446/125
4,310,994 A * 1/1982 Gephardt ..... E04B 2/12 52/608
4,317,654 A * 3/1982 Wahl ..... G09B 23/04 434/211
4,323,244 A * 4/1982 Busing ..... A63F 9/12 156/73.1
4,323,245 A * 4/1982 Beaman ..... A63F 9/1288 273/157 R
4,676,507 A * 6/1987 Patterson ..... A63F 9/12 273/160
4,753,622 A * 6/1988 Nakama ..... E04B 2/12 446/85
5,169,352 A * 12/1992 Petersen ..... A63H 33/04 446/117
5,221,223 A * 6/1993 Kao ..... A63H 33/06 446/124

(Continued)

*Primary Examiner* — Melba Bumgarner
*Assistant Examiner* — Joseph B Baldori
(74) *Attorney, Agent, or Firm* — Haug Partners LLP; Jon E. Gordon

(57) ABSTRACT

A mechanical connection unit may create a structure when removably joined with copies of itself, copies of minor-image counterparts of itself, or both. A connection unit may be made of four joined members, two of the members having the shape of isosceles right triangular prisms with right triangles as bases, and two of the members having the shape of truncated isosceles right triangular prisms with right triangles as bases. Two of the members are joined substantially parallel to each other and substantially at a right angle to the other two members.

Sets of units and minor-image counterpart units may be provided, e.g., as toys, and units and counterparts may be provided in multiple sizes.

4 Claims, 11 Drawing Sheets

(56) References Cited

U.S. PATENT DOCUMENTS

| | | | | |
|---|---|---|---|---|
| 7,063,587 | B1 * | 6/2006 | Lin | A63H 33/086 273/156 |
| D739,896 | S * | 9/2015 | Peker | D21/479 |

* cited by examiner

MECHANICAL CONNECTION UNIT

CROSS-REFERENCE TO RELATED APPLICATION

This application claims the benefit of U.S. provisional patent application No. 62/178,875, filed 22 Apr. 2015 and titled "Mechanical Connection Unit", which is hereby incorporated herein by reference.

COPYRIGHT NOTICE

A portion of the disclosure of this patent document contains material that is subject to copyright protection. The copyright owner has no objection to the facsimile reproduction by anyone of the patent document or the patent disclosure as it appears in the Patent and Trademark Office patent files or records, but otherwise reserves all copyrights whatsoever.

BACKGROUND

Sets of connecting units that may be joined to form structures are known and are often (but not always) sold as toys. The pieces in these sets typically favor one direction when adding pieces to a structure. For example, most common LEGO® bricks are joined by stacking one brick atop one or more others. Such sets may also require many different shapes of pieces to provide more flexibility in building. A set of connection units that supported building in multiple styles and directions using only a minimal number of different shapes would facilitate creating new kinds of structures and, as toys, would provide new opportunities for learning and creative expression.

BRIEF SUMMARY

A connection unit according to an embodiment of the invention may be made of four joined members, two of the members having the shape of isosceles right triangular prisms with right triangles as bases, and two of the members having the shape of truncated isosceles right triangular prisms with right triangles as bases. Two of the members may be joined substantially parallel to each other and substantially at a right angle to the other two members. ("Joined" in this sense means that each member is joined directly to at least one other member to form the unit; it does not require that all members be joined directly to each other.)

According to an embodiment of the invention, a mechanical connection unit may create a structure when removably joined with copies of itself, copies of mirror-image counterparts of itself, or both. Thus, according to embodiments of the invention, sets of units and minor-image counterpart units may be provided, e.g., as toys. In embodiments, units and counterparts may be provided in multiple sizes.

According to an embodiment of the invention, every portion of a unit may potentially be structurally engaged when removably joined to other units. This configuration may, e.g., allow for stability and a particularly efficient distribution of weight.

A unit according to an embodiment of the invention may have two ends, which are separated by a right angle. A unit may be connected to other units at either end or both ends, allowing a structure consisting of the units to grow naturally in multiple directions.

By combining units in different arrangements, novel patterns of voids may be formed. Because units in an embodiment of the invention may be connected, e.g., by inserting one or two projecting members from a unit into a void created by other units, these novel patterns of voids may permit units to be connected in unforeseen configurations.

According to an embodiment of the invention, a piece for a construction system comprises a first member having the shape of a truncated right triangular prism that has a square face and an oblique face. The cross-section of the prism, except for the truncated part, is an isosceles right triangle, and the oblique face makes an angle of 45 degrees with a plane parallel to a leg side of the prism.

The piece further comprises a second member having the having the shape of a right triangular prism. The cross section of the prism is an isosceles right triangle substantially identical in size to the square face of the first member, and one face of the second member is attached to a leg side of the first member such that the hypotenusal side of the second member is flush with the oblique face of the first member.

The piece further comprises a third member that is identical in size and shape to the first member, a leg side of the third member being attached to a leg side of the first member aligned so that (a) the hypotenusal side of the third member is flush with the hypotenusal side of the second member, and (b) the face of the third member distal from the first member is flush with the face of the second member distal from the first member.

The piece further comprises a fourth member that is identical in size and shape to the second member. The fourth member is attached to the end of a leg face of the third member proximal to the first member aligned so that (c) the hypotenusal side of the fourth member is flush with the hypotenusal side of the first member, and (d) the hypotenusal side of the fourth member is flush with the oblique face of the third member.

According to an embodiment of the invention, each leg of the square face of the first member is 1 unit long, the first member has a height that proceeds from a minimum of 3 units to a maximum of 4 units, and the second member has a height of 2 units.

According to an embodiment of the invention, a construction set comprising a plurality of pieces is provided. The plurality of pieces comprises a first plurality of pieces that are pieces as above described. The plurality of pieces further comprises a second plurality of pieces that have a shape that is a mirror image of the first plurality of pieces.

According to an embodiment of the invention, the plurality of pieces comprises a third plurality of pieces that are identical in shape to the first plurality of pieces but scaled to a size different from the first plurality of pieces. The plurality of pieces further comprises a fourth plurality of pieces that have a shape that is a mirror image of the third plurality of pieces.

BRIEF DESCRIPTION OF THE DRAWINGS

The invention is illustrated in the figures of the accompanying drawings, which are meant to be exemplary and not limiting, and in which like references are intended to refer to like or corresponding things.

DETAILED DESCRIPTION OF THE PREFERRED EMBODIMENTS

Embodiments of the invention may include units that comprise multiple members that have the shapes of right triangular prisms or truncated right triangular prisms. According to embodiments of the invention, a unit may be formed, e.g., by permanently joining two or more pieces into a unit that has a shape as described here. According to alternative embodiments of the invention, a unit may be formed, e.g., as a single, indivisible piece that has the same shape as a unit comprised of multiple members joined together. In either case, "member" may refer to any of the projecting parts of the unit.

A right triangular prism is a pentahedron that has two parallel faces, which are congruent triangles, and three rectangular faces. The triangular faces may be called bases, and the rectangular faces may be called lateral faces. An isosceles right triangular prism is a right triangular prism that has isosceles triangles as bases.

If the bases are right triangles, then one side of each triangle is the hypotenuse, and the other two sides of the triangles are legs. For a right triangular prism that has bases that are right triangles, the lateral face that joins the hypotenuses may be called the hypotenusal face. The other two lateral faces may be called leg faces. It will be appreciated that, if the bases are isosceles right triangles, then the leg faces are congruent to each other.

A truncated right triangular prism is a right triangular prism that has had one base cut off by an intersecting plane that is oblique to the other base. The face of the prism that is parallel to the intersecting plane may be called the oblique face.

A prism may be considered to have an axis, which may be a line that intersects the centroids of both bases. A truncated prism may also be considered to have an axis, which may be a line that intersects the centroid of the base and the centroid of the oblique face.

Figure 1:
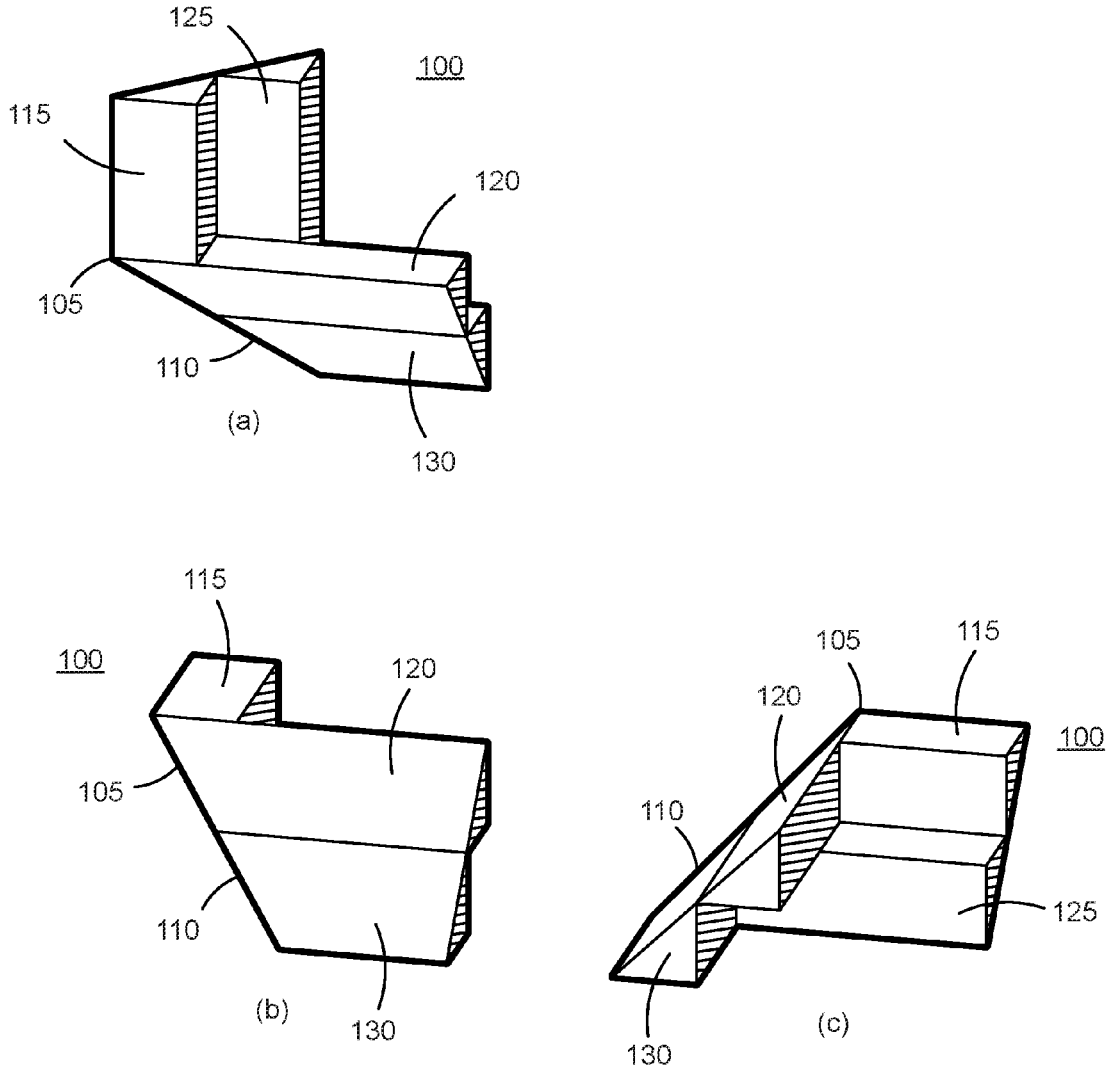
FIG. 1 presents perspective views of a connection unit according to an embodiment of the invention.
Figure 2:
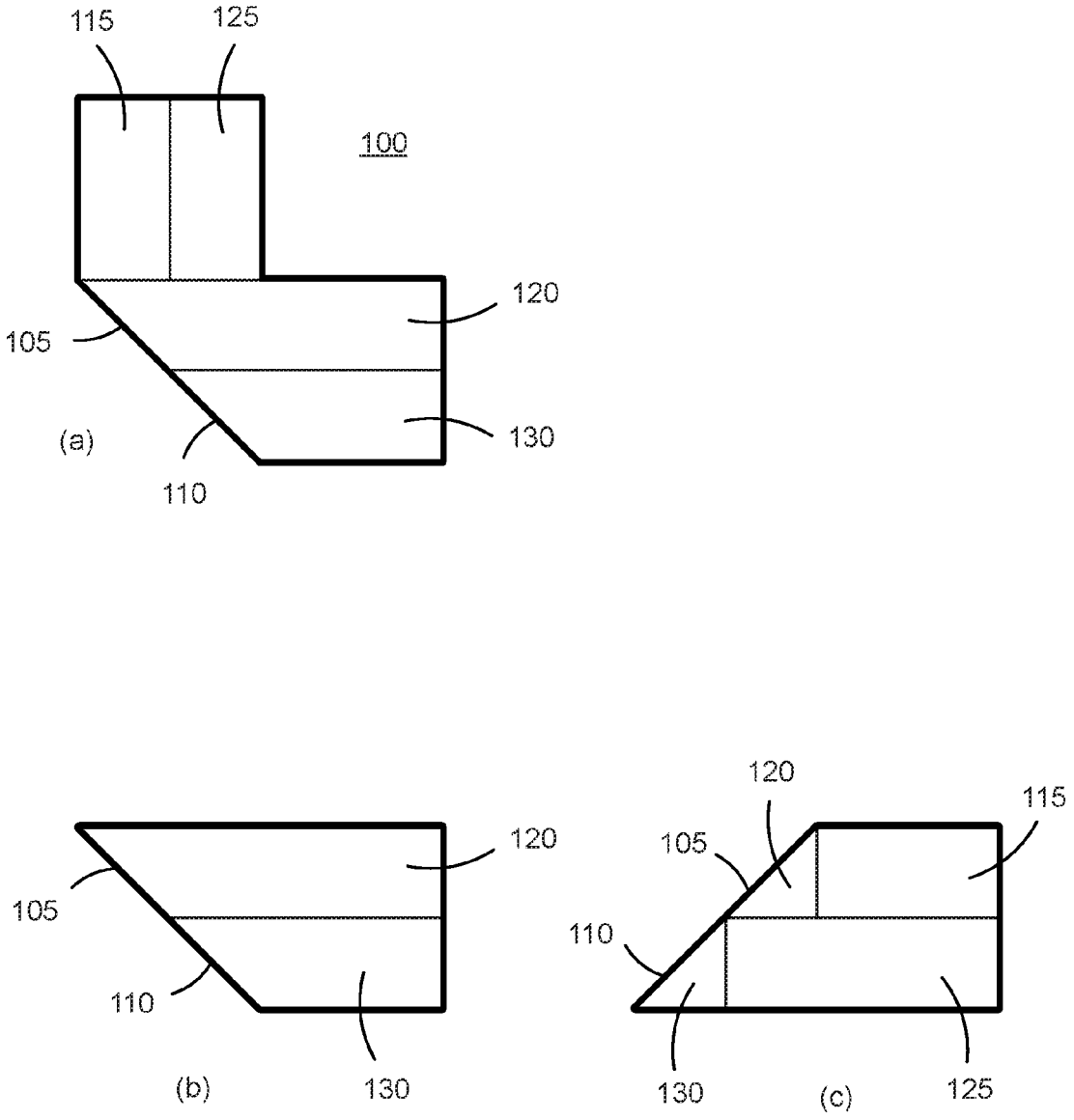
FIG. 2 presents orthographic views of a connection unit according an embodiment of the invention.

FIG. 1 includes perspective views of a mechanical connection unit 100 according to an embodiment of the invention, and FIG. 2 depicts the unit 100 from (a) above, (b) the front, and (c) the right side. As depicted, the unit 100 consists of four permanently joined members, each member having the shape of a right triangular prism or a truncated right triangular prism. The bases of each of the members are isosceles right triangles.

Two of the members 115, 130 are identical right triangular prisms. As depicted, the legs of the prisms are each 1 unit long, and the height of the prisms is 2 units. (The dimensions of the members are described here in terms of generic "units" to indicate relative sizes. As discussed below, units 100 according to embodiments of the invention may have varied sizes so long as the relative proportions within a single unit remain as disclosed.)

Figure 3:
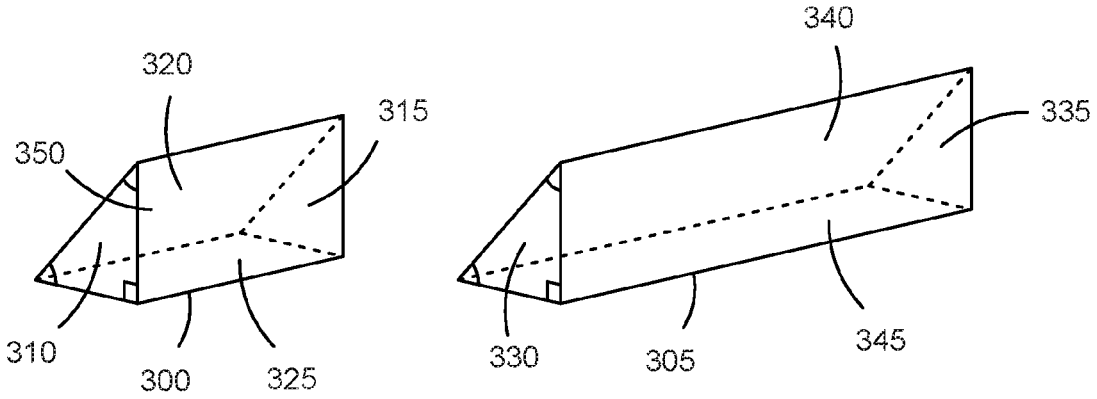
FIG. 3 depicts a member such as may be comprised by a connection unit according to an embodiment of the invention.

In the depicted embodiment of the invention, the other two members 120, 125 are truncated right triangular prisms. FIG. 3 depicts one member 120. As depicted, the triangular bases of the prisms are isosceles right triangles, the legs of which are each 1 unit long.

The oblique face of the prism is defined by a cut plane that has an angle of 45 degrees to the plane that includes one of the leg faces of the prism. The resulting leg face is a rectangle with a length of three units and a width of 1 unit. The other leg face and the hypotenusal face are right trapezoids, of which one base is three units long and the other base is four units long. Member 125 is identical to member 120.

Figure 4:
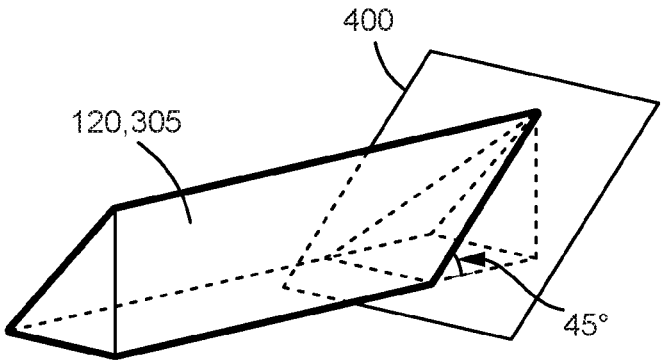
FIG. 4 depicts conceptually a truncated right triangular prism.

FIG. 4 depicts a right triangular prism 305 intersecting a cut plane 400. FIG. 4 merely further illustrates the shape of a member shaped as a truncated right triangular prism according to an embodiment of the invention. It does not depict a necessary or preferred step in manufacture or assembly of a member or unit.

Figure 5:
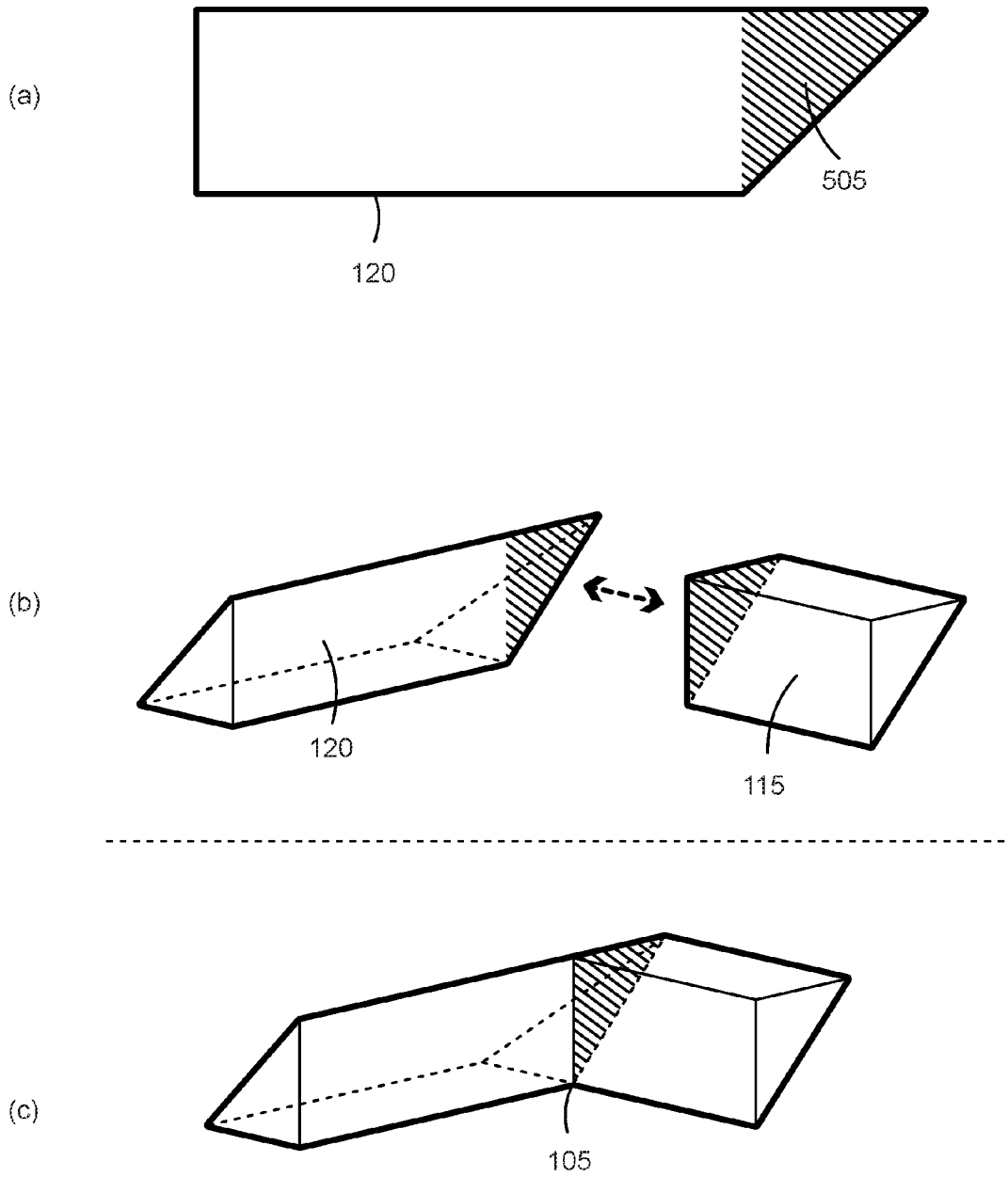
FIG. 5 depicts assembly of members into a connection unit according to an embodiment of the invention.
Figure 6:
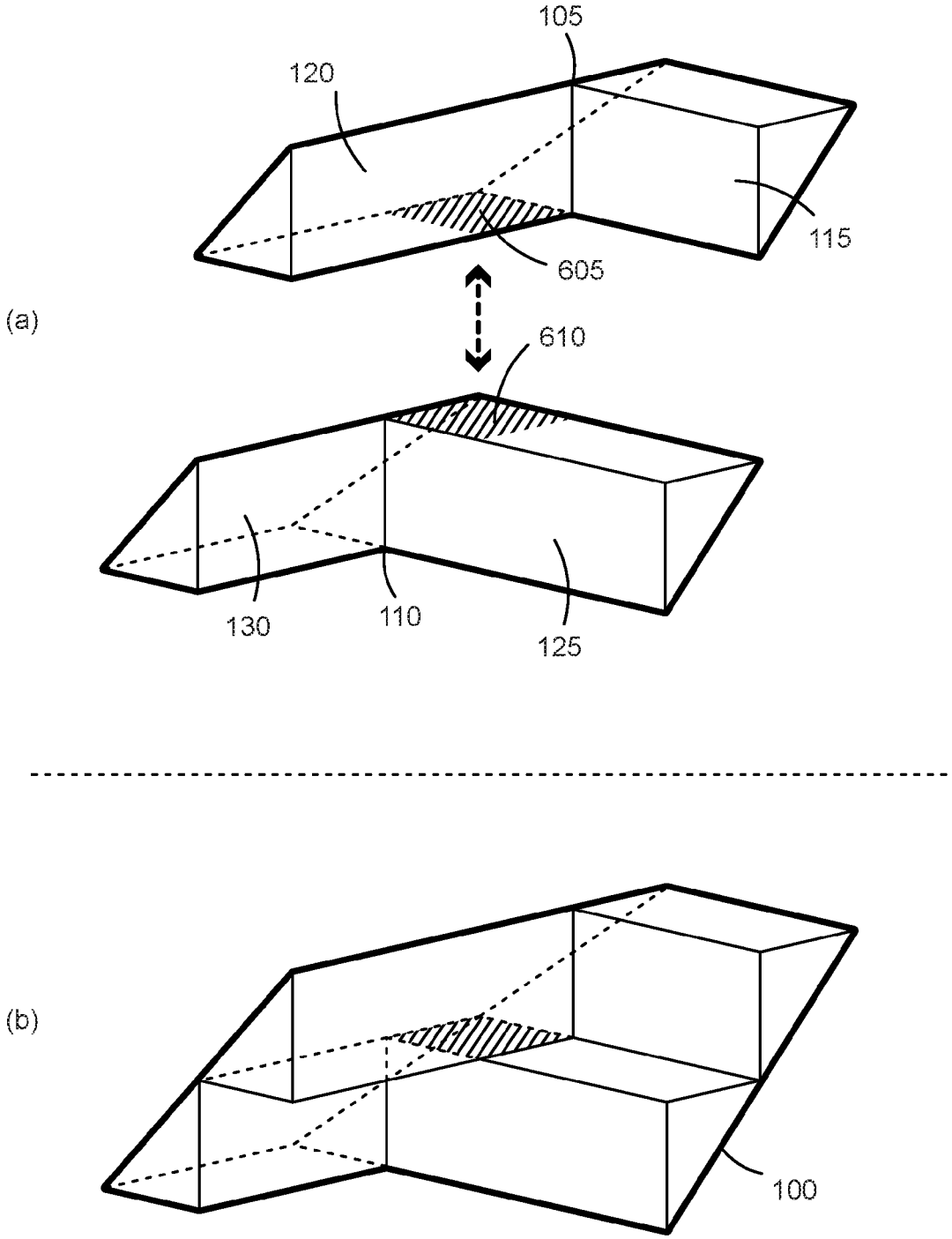
FIG. 6 depicts assembly of members into a connection unit according to an embodiment of the invention.

FIG. 5 and FIG. 6 illustrate the relative positions of the members in a unit 100 according to an embodiment of the invention by depicting possible stages in assembling the unit from its members. It bears emphasis, however, that a unit according to an embodiment need not be assembled as described; rather, a unit in an embodiment may be, e.g., assembled from parts that differ in shape, number, or both from those depicted and discussed, it may be molded as a single piece, or it may be carved from one or more blocks of material, among other possibilities. This description of assembly is meant only to illustrate a final configuration of members according to an embodiment of the invention by showing one possible way (of many) to produce that configuration.

FIG. 5 depicts assembly of members 115, 120 into a unit 105 according to an embodiment of the invention. At (a), the trapezoidal leg face of member 120 is depicted straight on. The depicted face includes a triangular contact region 505 that is congruent to the base of member 115. At (b), the base of member 115 may be affixed to the contact region 505 of member 120, e.g., by glue, a mechanical fastener, or both. The result of affixing the members 115, 120 in this configuration is that the hypotenusal face of member 115 is coplanar with the oblique face of member 120. At (c), the result of this assembly is depicted as a unit 105.

Members 125 and 130 may similarly be affixed to one another to form a unit 110, as FIG. 6 depicts. Unit 105 and 110 may then be aligned to each other and affixed. The depicted alignment of unit 110, relative to unit 105, may be achieved, e.g., by placing unit 110 into the same alignment as unit 105, and then, first, rotating the unit 110 by 180 degrees around the axis of member 130 and, second, rotating the unit 110 clockwise 90 degrees in the plane that includes the axis of member 125 and member 130.

As depicted, according to an embodiment of the invention, unit 105 and unit 110 may then be affixed to each other such that the hypotenusal face of member 115 is coplanar with the oblique face of member 120 and the hypotenusal face of member 125, while the hypotenusal face of member 120 is coplanar with the oblique face of member 125 and the hypotenusal face of member 130.

In the alignment described above, an area of contact 605, 610 will exist between unit 105 and 110. The area of contact 605, 610 is one unit square. Unit 105 may be affixed to unit 110, e.g., at this area by glue, a mechanical fastener, or both. In an embodiment of the invention, the result of this joining is the unit 100.

It will be appreciated that embodiments of the invention may be intended for use as toys and that dimensions and alignments may not be critical in an embodiment so long as variances do not interfere with uses such as described below. Relatedly, it may be desirable in an embodiment of the invention for a small gap to exist between the hypotenusal face of member 115 and the hypotenusal face of member 125 and a small gap to exist between the hypotenusal face of member 120 and the hypotenusal face of member 130, e.g., to facilitate interconnecting units as described below.

Figure 7:
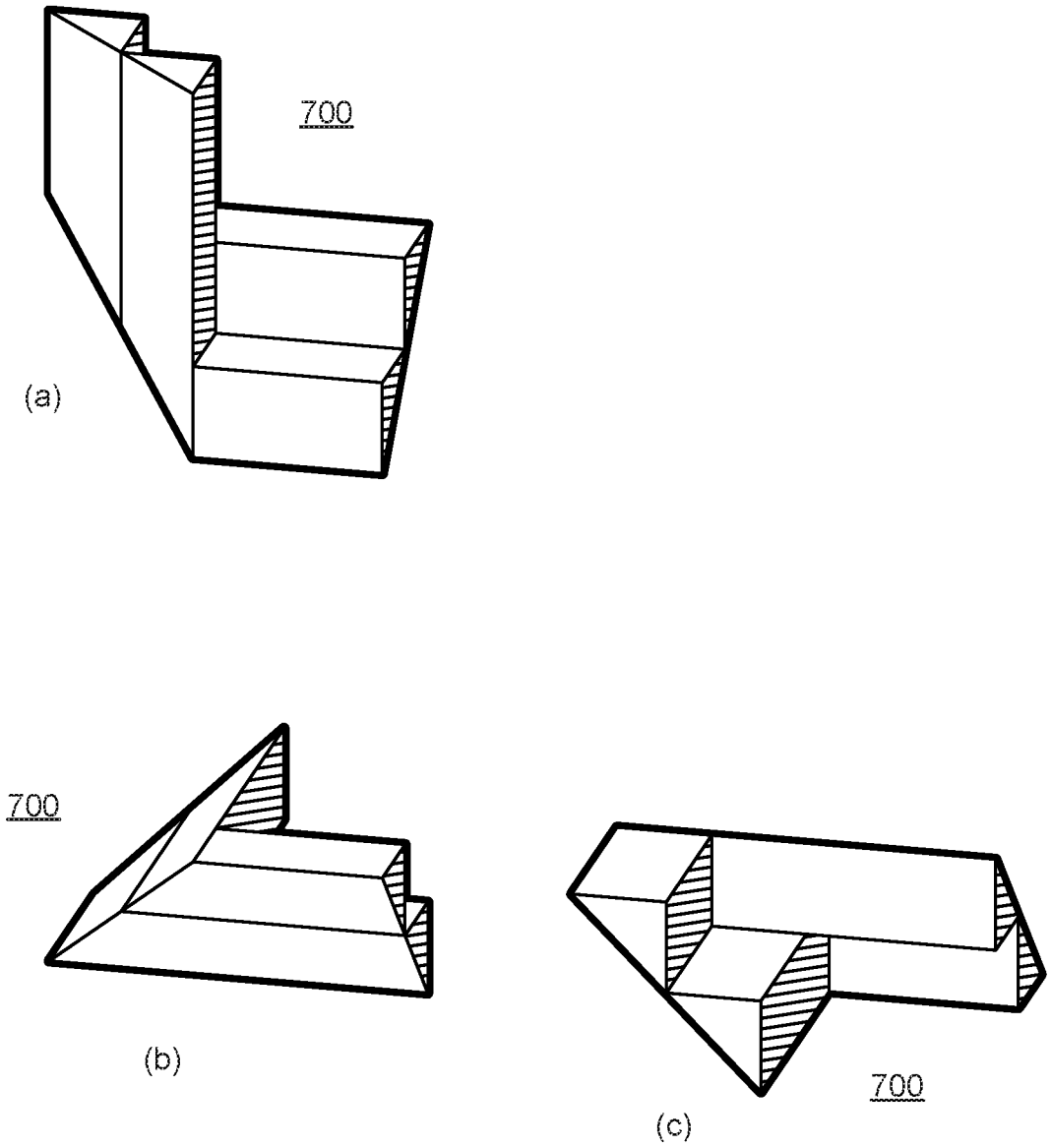
FIG. 7 presents perspective views of a counterpart connection unit according to an embodiment of the invention.
Figure 8:
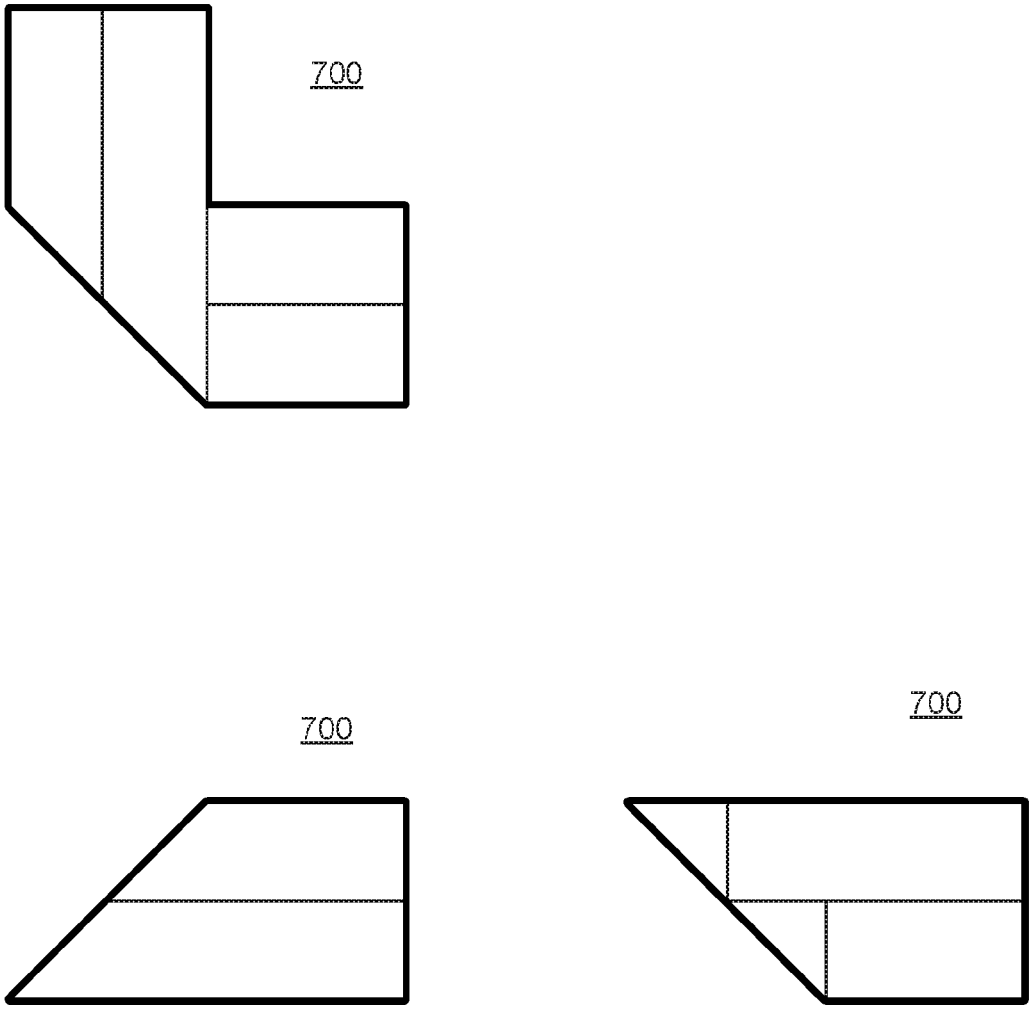
FIG. 8 presents orthographic views of a counterpart connection unit according an embodiment of the invention.

In connection with an embodiment of the invention the depicted unit 100 may be called, e.g., a "right unit", and there may be, e.g., a counterpart 700 such as FIG. 7 and FIG. 8 depict, which may be called a "left unit". In an embodiment, the shape of the left unit 700 may be, e.g., the reflection of the shape of the right unit 100 in a plane parallel to the base of member 120 or a plane parallel to the base of member 125. The left unit and the right unit may be referred to collectively as "the units".

Figure 9:
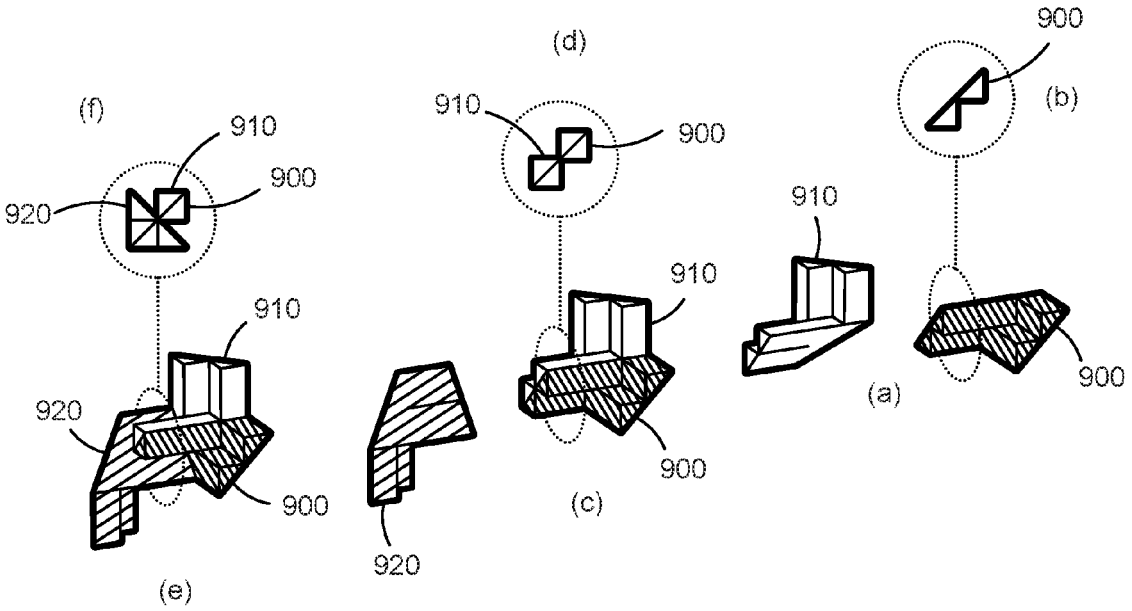
FIG. 9 depicts removably joining multiple connection units according to an embodiment of the invention.

A unit according to an embodiment of the invention may be removably connected to one or more copies of itself, one or more copies of its counterpart, or both. FIG. 9 depicts how units may be removably connected to others, e.g., by a user, to build a structure. At (a), a right unit 900 and a left unit 910 are separate, and at (b), the bases of two members of the right-unit 900 are depicted end-on.

At (c), the left unit 910 and the right unit 900 have been placed next to each other in a configuration suitable for connection, although they are not connected as depicted. At (d), the bases of two members each of the left unit 910 and the right unit 900 are depicted end-on to show their relative position in the configuration depicted at (c). Finally, at (e), a second right unit 920 has been slid over the adjacent members of the first right unit 900 and the left unit 910, thus holding the first right unit 900 and the left unit 910 together. At (f), a cross section is presented of the three units that are removably connected as depicted at (e).

Conversely, the units may be separated by first sliding the second right unit 920 from the other two and then separating the first right unit 900 from the left unit 910.

Figure 10:
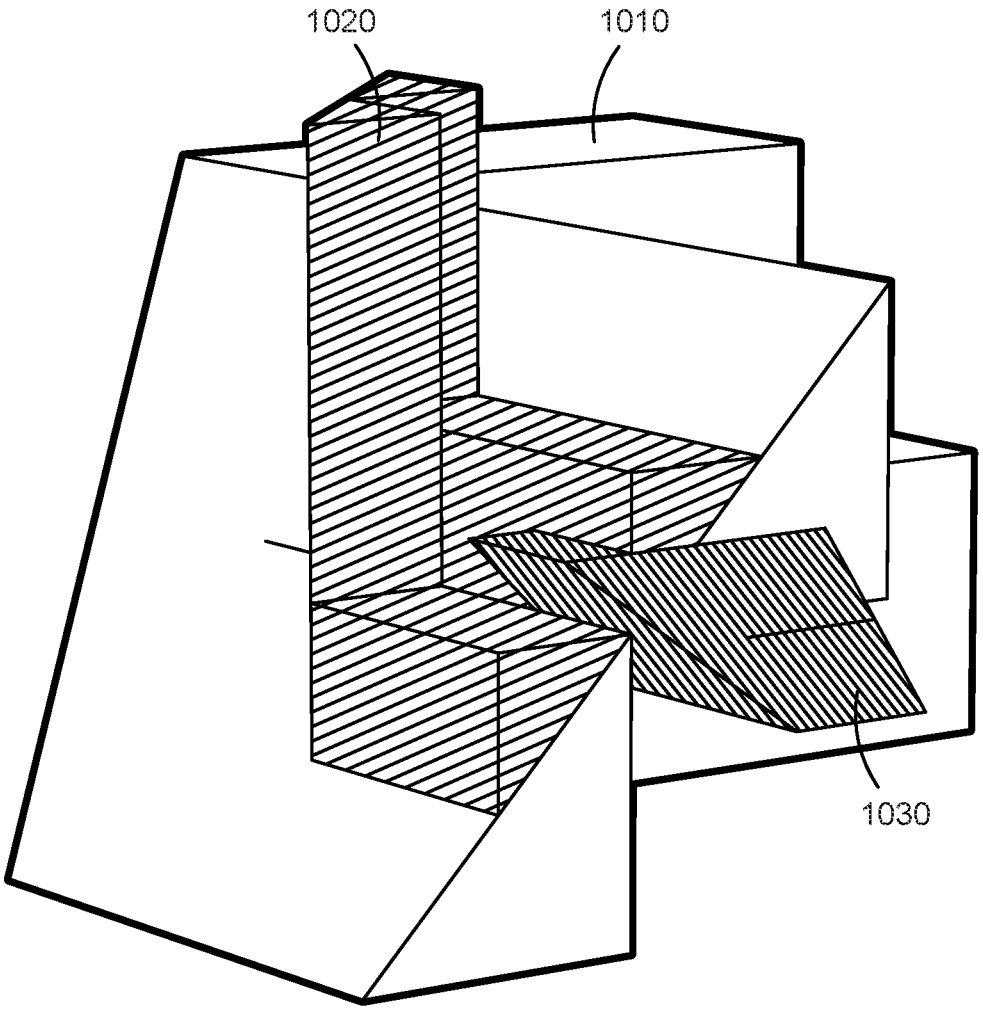
FIG. 10 depicts removably joined connection units of differing sizes according to an embodiment of the invention.

Units in an embodiment of the invention may be provided in multiple scales, i.e., having varying sizes but keeping the same shape and proportions within each unit. Due to the shapes of the units, differently-scaled units may nonetheless be removably connected, so long as the shape and proportions of each of the units are as described. For example, FIG. 10 depicts three units of different sizes 1010, 1020, 1030 that are removably interconnected in a configuration similar to that of FIG. 9.

In embodiments of the invention, a plurality of left units and a plurality of right units may be provided, and each type of unit may be provided in a plurality of sizes.

Units according to embodiments of this invention may be made of any material that is sufficiently rigid to substantially maintain the disclosed shapes and sufficient durable to withstand extensive use. The choice of material may also reflect the size of the units. It may also be desirable in an embodiment for the units to be made of a material or materials that exhibits sufficient surface friction to facilitate assembly of units into structures. Thus, for example, toys on the scale of a few inches may be made, e.g., of solid wood or molded thermoplastic, while units on the scale of a foot or more may be made, e.g., of hollow thermoplastic or rigid polystyrene foam, maintaining the strength and rigidity of the units and structures made from them while leaving the units light enough to be manipulated easily.

It will be appreciated that an object may be removably connected, e.g., to one or more units as disclosed here, so long as it comprises two appropriately shaped projections, e.g., as disclosed and depicted here, even if the object is not otherwise shaped like one of the disclosed connection units. In an embodiment of the invention, an object having two adjacent, parallel projections with cross sections that are isosceles right triangles in the depicted orientations may be removably connected to one or more units according to embodiments of the invention.

Figure 11:
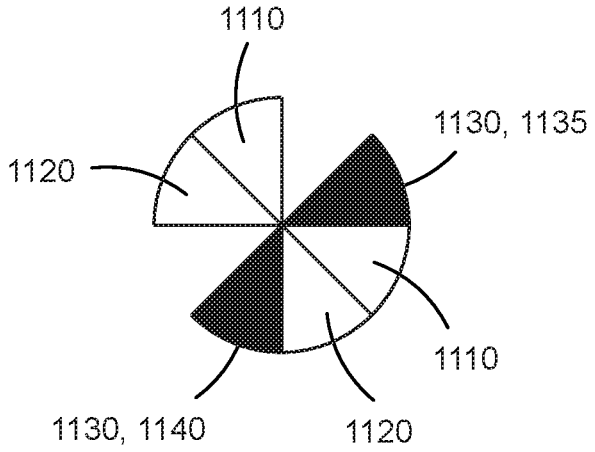
FIG. 11 depicts conceptually a configuration of members when three units are removably connected according to an embodiment of the invention.

The principle underlying removable connection of units according to embodiments of the invention is of broader application. FIG. 11 depicts conceptually a configuration of members when three units 1110, 1120, 1130 are removably connected according to embodiment of the invention. As depicted, each unit has two projecting members, each of which comprises two flat sides that meet at an edge (the "meeting edge") at an angle of 45 degrees. Each unit's members extend parallel to each other, with the members' meeting edges adjacent to each other. Additionally, for each unit, one side of one member is coplanar with one side of the other member.

As depicted, the mutually coplanar sides of the members of unit 1110 have been placed in contact with the mutually coplanar sides of the members of unit 1120. Also as depicted, the meeting edges of the members of unit 1110 are aligned with the meeting edges of unit 1120, and the members of both units project in the same direction. When the member 1110 and member 1120 are configured in this way, in embodiments of the invention, the members may be removably joined to each other and to member 1130 when the members of unit 1130, projecting in the opposite direction, are inserted between the members of the other two units, e.g., by sliding. As depicted, one member 1135 of unit 1130 is between the members of unit 1110, and the other member 1140 of unit 1130 is between the members of unit 1120. In this configuration, in an embodiment of the invention, the members of unit 1130 hold the members of units 1110 and 1120 against each other, and friction between the members may hold the units in this configuration.

The invention has been described in terms of illustrative embodiments. It will be appreciated that the invention may subsume embodiments in addition to those described here, and the invention is therefore limited only by the claims and not by the detail of any particular embodiment.

I claim:

1. A piece for a construction system, comprising:

a first member having the shape of a truncated right triangular prism that has a triangular face, an oblique face, a hypotenusal face, a first leg face, and a second leg face, the cross-section of the prism, except where the prism is truncated, being an isosceles right triangle, and the oblique face making an angle of 45 degrees with a plane parallel to the first leg face of the prism;

a second member having the having the shape of a right triangular prism that has a first triangular face, a second triangular face, a hypotenusal face, a first leg face, and a second leg face, the cross section of the prism being an isosceles right triangle identical in size to the triangular face of the first member, the first triangular face of the second member being attached to the second leg face of the first member such that the hypotenusal face of the second member is coplanar with the oblique face of the first member;

a third member that is identical in size and shape to the first member, the third member having a triangular face, an oblique face, a hypotenusal face, a first leg face, and a second leg face, the first leg face of the third member being attached to the first leg of the first member aligned so that:

(a) the hypotenusal face of the third member is coplanar with the hypotenusal face of the second member, and (b) the triangular face of the third member is coplanar with the second triangular face of the second member; and a fourth member that is identical in size and shape to the second member, the fourth member having a first triangular face, a second triangular face, a hypotenusal face, a first leg face, and a second leg face, the first triangular face of the fourth member attached to the second leg face of the third member, proximal to the first member, and aligned so that:

(c) the hypotenusal face of the fourth member is coplanar with the hypotenusal face of the first member, and (d) the hypotenusal face of the fourth member is coplanar with the oblique face of the third member, wherein:

a first gap separates the first member from the fourth member, a second gap separates the second member from the third member, and the first gap and the second gap are each configured to permit removably interconnecting the piece ("the first piece") with a second piece that is either identical to the first piece or a mirror image of the first piece by sliding the first piece and the second piece together so that either the first gap or the second gap of the first piece intersects either the first gap or the second gap of the second piece.

2. The piece of claim 1, wherein:

each leg of the triangular face of the first member is 1 unit long;

the second leg face of the first member is a right trapezoid, the right trapezoid having a first base that is 3 units long and a second base that is 4 units long; and the second member has a height of 2 units.

3. A construction system, comprising:

a first plurality of the pieces of claim 1; and a second plurality of pieces that have a shape that is a mirror image of the pieces in the first plurality of pieces.

4. The construction system of claim 3, comprising:

a third plurality of pieces that are identical in shape to the first plurality of pieces but scaled to a size different from the first plurality of pieces; and a fourth plurality of pieces that have a shape that is a mirror image of the third plurality of pieces.

* * * * *